United States Patent [19]

Röhm

[11] Patent Number: 4,932,643

[45] Date of Patent: Jun. 12, 1990

[54] MACHINIST'S VISE

[76] Inventor: Günter H. Röhm, Heinrich-Röhm-Strasse 50, D-7927 Sontheim, Fed. Rep. of Germany

[21] Appl. No.: 288,406

[22] Filed: Dec. 21, 1988

[30] Foreign Application Priority Data

Dec. 29, 1987 [DE] Fed. Rep. of Germany ... 8717051[U]

[51] Int. Cl.[5] ..... B25B 1/00

[52] U.S. Cl. ..... 269/244; 269/245

[58] Field of Search ..... 269/202, 212, 240, 244, 269/258, 245

[56] References Cited

U.S. PATENT DOCUMENTS

| | | | |
|---|---|---|---|
| 287,271 | 10/1883 | Gladwin | 269/244 |
| 807,788 | 12/1905 | Stetler | 269/244 |
| 2,247,656 | 7/1941 | Friedrich | 269/244 |
| 4,232,857 | 11/1980 | Bezubik et al. | 269/244 |
| 4,685,663 | 8/1987 | Jorgensen | 269/244 |
| 4,695,046 | 9/1987 | Berleth | 269/244 |

*Primary Examiner*—Judy Hartman

*Attorney, Agent, or Firm*—Herbert Dubno; Andrew Wilford

[57] ABSTRACT

A vise has a housing block formed with a guide defining a longitudinal direction, a fixed jaw secured to the block, a movable jaw displaceable in the direction in the guide relative to the fixed jaw, and a spindle extending in the direction between the jaws along a spindle axis. A support at the fixed jaw has a formation fitting with the fixed jaw and fixing the support and fixed jaw together against relative axial displacement while permitting limited relative pivoting about a fixed-jaw axis generally perpendicular to the spindle axis. Similarly a bearing between the spindle and the support fixes same against relative displacement along the spindle axis while permitting the spindle to rotate relative to the support about the spindle axis and a nut threaded on the spindle at the movable jaw has a formation fitting with the movable jaw for fixing the nut and movable jaw together against relative displacement parallel to the spindle axis while permitting limited relative pivoting about a movable-jaw axis generally parallel to the fixed-jaw axis.

9 Claims, 3 Drawing Sheets

MACHINIST'S VISE

FIELD OF THE INVENTION

The present invention relates to a machinist's vise. More particularly this invention concerns such a vise used to hold a workpiece in a drill press or the like.

BACKGROUND OF THE INVENTION

A standard machinist's vise has a housing block that is normally bolted to the bed of the machine being used, a fixed jaw essentially integral with this block, a movable jaw slidable in a longitudinal direction on the block toward and away from the fixed jaw, and a threaded spindle for effecting this movement. One end of the spindle normally engages in a bearing in the block or fixed jaw and is threaded in a nut in the movable jaw and this spindle extends parallel to the vice-closing and -opening direction so that rotation of the spindle in one direction moves the jaws, that is it does not engage them at locations generally centered above the spindle axis, the jaws tend to cant or twist relative to one another and to the housing block. Since such a vice typically is used to exert considerable force, this offcenter action can distort much of the structure of the vise. In particular the spindle can be deformed or wedged in its bearing in the block or its nut in the movable jaw. In order to prevent the device from binding, it is therefore necessary to manufacture the guides in the housing block, the corresponding parts of the movable jaw, the spindle, and the nut to very close tolerances so that such twisting is not concentrated as a force in one location.

Even a very carefully constructed such vise can, however, bind and deform when an offcenter workpiece is clamped very tightly. This can lead to premature wear of the spindle, and generally makes it difficult to tighten and loosen the vise.

OBJECTS OF THE INVENTION

It is therefore an object of the present invention to provide an improved machinist's vise which overcomes the above-given disadvantages, that is which can solidly and easily clamp a workpiece offcenter without requiring extremely high manufacturing tolerances or putting an undue strain on the elements of the vise.

SUMMARY OF THE INVENTION

The vise according to this invention has a housing block formed with a quide defining a longitudinal direction, a fixed jaw secured to the block, a movable jaw displaceable in the direction in the guide relative to the fixed jaw, and a spindle extending in the direction between the jaws along a spindle axis. A support at the fixed jaw has a formation fitting with the fixed jaw and fixing the support and fixed jaw together against relative axial displacement while permitting limited relative pivoting about a fixed-jaw axis general perpendicular to the spindle axis. Similarly a bearing between the spindle and the support fixes same against relative displacement along the spindle axis while permitting the spindle to rotate relative to the support about the spindle axis and a nut threaded on the spindle at the movable jaw has a formation fitting with the movable jaw for movable the nut and fixed jaw together against relative displacement parallel to the spindle axis while permitting limited relative pivoting about a movable-jaw axis generally parallel to the fixed-jaw axis.

Thus with this system any canting of the fixed or movable jaw will not be transmitted to the spindle. It is therefore possible to forcefully clamp a workpiece even offcenter without risking any bending of this spindle. It comes impossible for the spindle to bind in either the nut or its bearing so that the spindle will be stressed only in tension.

According to a feature of the invention the formations between the support and fixed jaw include a pin centered on the fixed-jaw axis and projecting from the support and a complementary recess formed in the fixed jaw. In addition the quide includes a pair of substantially parallel surfaces extending parallel to the spindle axis and perpendicular to the jaw axes and both the support and movable jaw are supported on these surfaces. This quide is a pair of grooves open toward each other and having flanks forming the surfaces.

The formations between the movable jaw and the nut according to this invention include an outer surface on the nut formed as a body of revolution centered on the movable-jaw axis and a complementary recess formed in the movable jaw. This body of revolution is a cylinder and the nut has a diametral threaded bore receiving the spindle.

In accordance with a further feature of this invention the movable jaw is formed centered on the axis with a throughgoing bore receiving the spindle with substantial play and this fixed jaw is provided with a slide movable in the guide and receiving the nut with means for displacing the movable jaw along the spindle axis relative to the slide.

DESCRIPTION OF THE DRAWING

The above and other objects, features, and advantages will become more readily apparent from the following, reference being made to the accompanying drawing in which.

SPECIFIC DESCRIPTION

Figure 1:
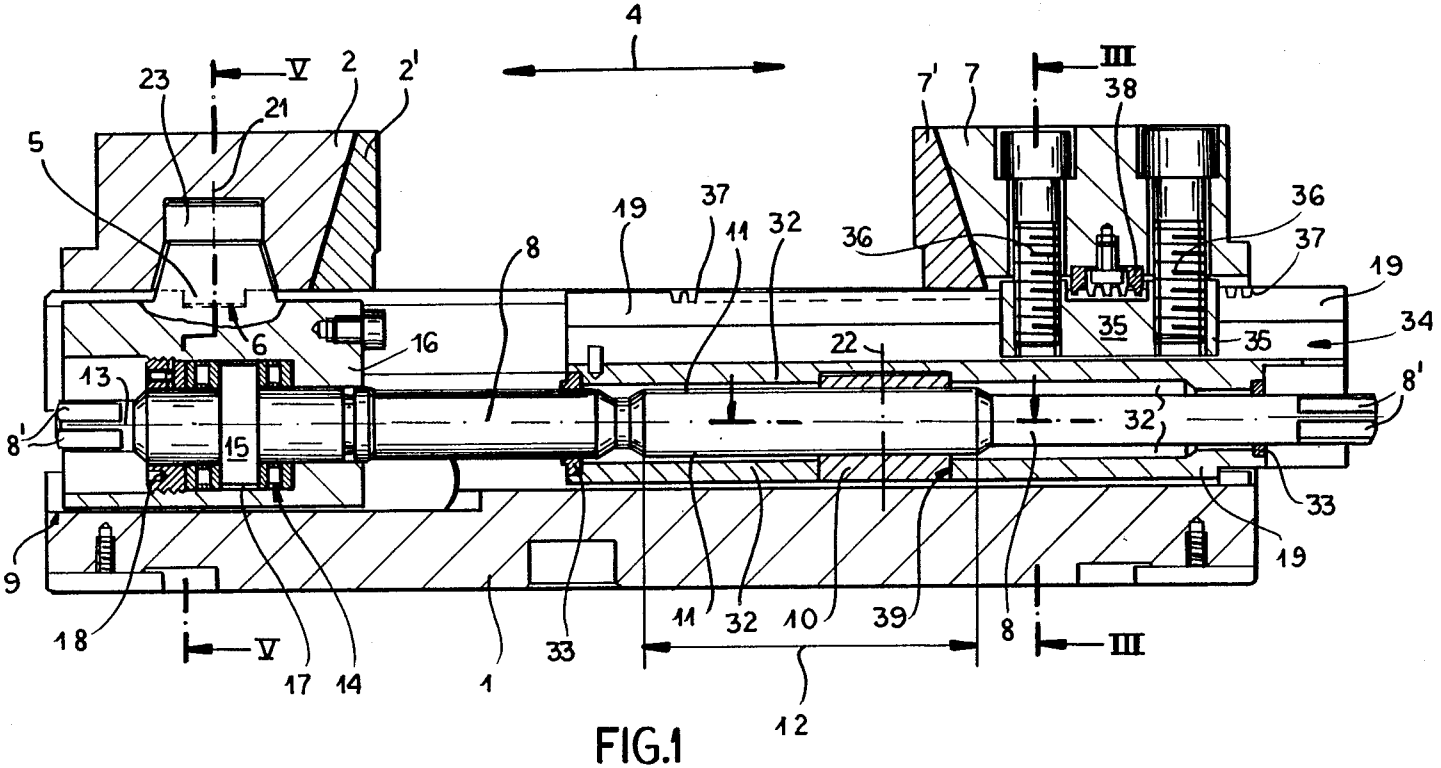
FIG. 1 is a vertical axial section through the vise of this invention.
Figure 2:
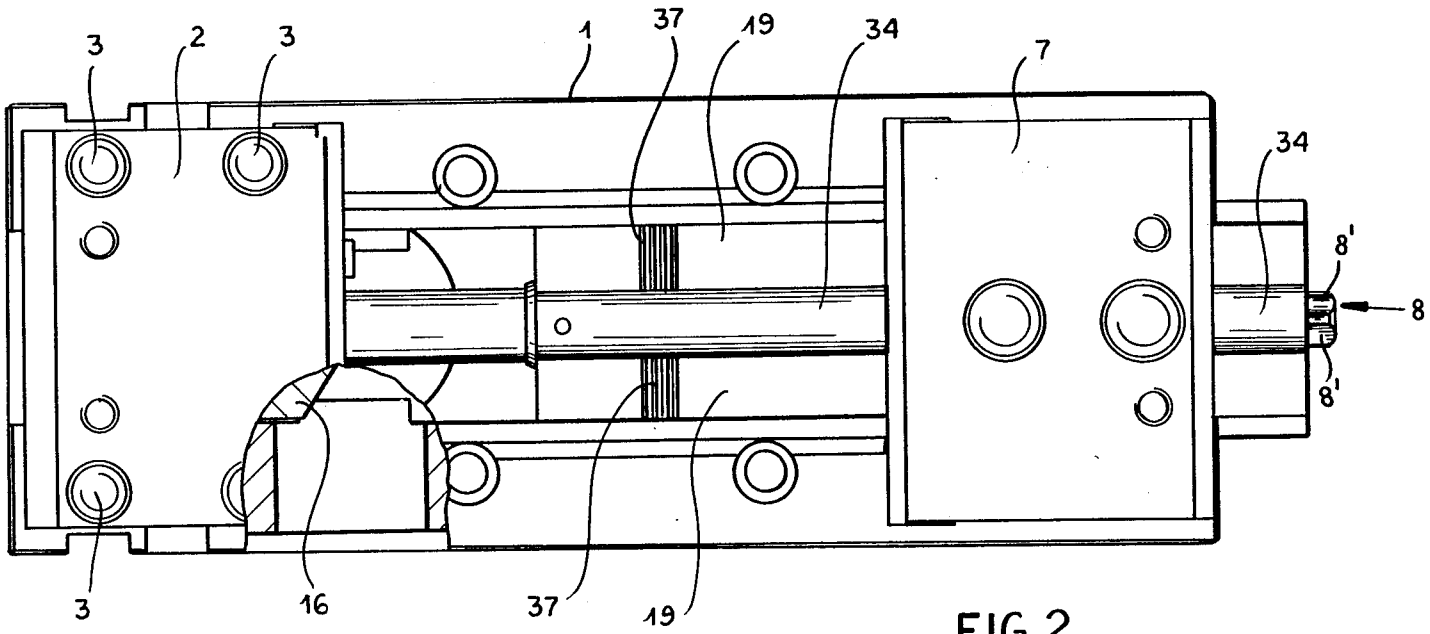
FIG. 2 is a top view of the vise.

As seen in the drawing the vise according to this invention has a housing block 1 that is normally adapted to be bolted to the bed of a drill press or the like and that is formed as a machined block of steel. A fixed jaw 2 is secured by screws 3 (see FIG. 2) to this block 1 and has a downwardly projecting transverse ridge 5 extending perpendicular to a vise-closing and -opening direction 4 and fitting in a complementary upwardly open groove 6 of the block 1. This jaw 2 carries a replaceable face plate 2' and is in effect integral with the body 1.

A movable jaw 7 having a face plate 7' confronts the jaw 2 in the direction 4 and can be moved in this direction by means of a spindle 8 centered on an axis 13 and secured against axial displacement in the housing 1 by a bearing indicated generally at 9. A nut 10 formed with internal threads 10' meshes with an external thread 11 of the spindle 8 and is seated in a slide 19. The threads 11 extend over an axial distance 12 which, therefore, corresponds to the range of adjustability, that is the distance through which the jaw 7 can be displaced in the direction 4. The bearing 9 is formed by a pair of roller-type axial thrust bearings 14 flanking an annular collar 15 on the spindle 8 and received in a cylindrical recess 17 formed in a support 16. A threaded washer 18 holds the two bearings 14 in place.

Figure 5:
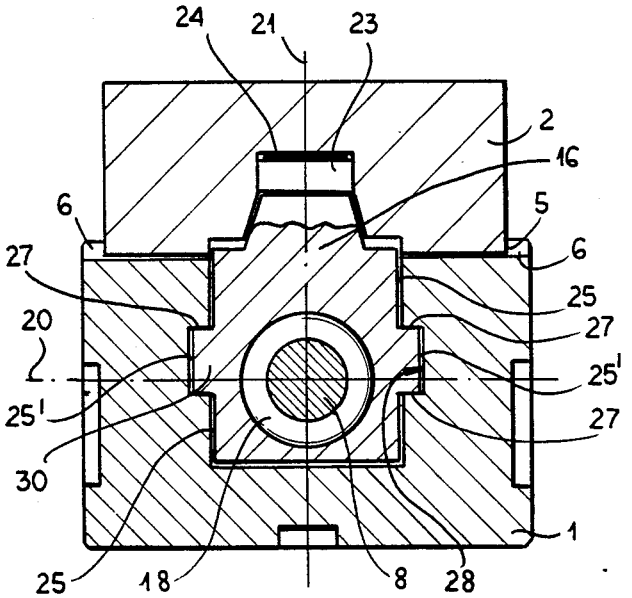
FIG. 5 is a cross section taken along line V—V of FIG. 1.

The support 16, which is also seen in FIG. 5, is formed with a pair of horizontally projecting ribs 30 received in grooves 28 formed in the block 1 and having horizontal flanks 27 snugly engaging the top and bottom faces of the groove 28. The vertical surfaces of the sides of the support 16 and of the ribs 30 are received with horizontal spacing or play 25 and 25'in the block 1 so that this support 16 can cant somewhat about an axis 21 perpendicular to the axis 13 and to a horizontal plane 20 extending through the axis 13. The top of the support 16 is formed centered on the axis 21 with an upwardly projecting pin 23 of cylindrical/frustoconical shape received in a complementary downwardly open recess 24 formed in the jaw 2. This makes it possible for the support 16 and spindle 8 to twist somewhat relative to the jaw 2 about the axis 21.

Figure 3:
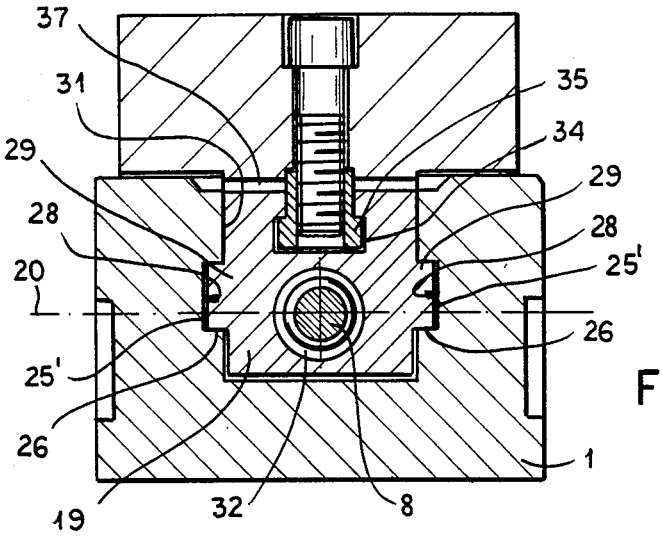
FIG. 3 is a cross section taken along line III—III of FIG. 1.
Figure 4:
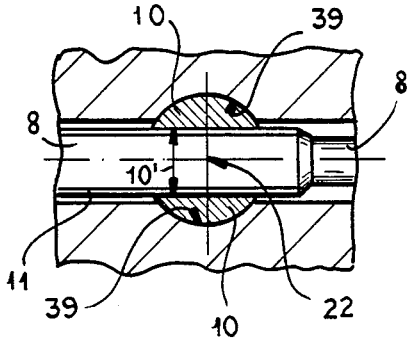
FIG. 4 is a longitudinal section through the vise.

As seen in FIG. 4 the nut 10 is shaped externally as a cylinder centered on an upright axis 22 perpendicular to the axis 13 and received in a complementary pocket 39 formed in a slide 19 to which the jaw 7 is secured. This slide 19 itself is formed as shown in FIG. 3 with a pair of horizontally projecting ribs 29 received in the grooves 28 and having horizontal flanks 26 snugly engaging the top and bottom faces of the grooves 28. The upper portions 31 of the vertical surfaces of the sides of the slide 19 and of the ribs 30 are received snugly, that is without horizontal spacing or play in the block 1 so that this slide 19 cannot cant somewhat about the axis 22. The spindle 8 passes completely through a bore 32 formed in the slide 19 and sealed at both ends around the spindle 8 by rubber washers 33. In addition the ends 8' of the spindle 8 are formed with facets so that they can be engaged by a tool for rotation of this spindle 8. In this arrangement relative twisting of the spindle 8 and the slide 19 is permitted as relative rotation between the nut 10 and the block 19.

The jaw 7 can be moved on the slide 19. To this end the slide 19 is formed with an inverted T-slot 34 in which can slide a T-foot 35 bolted to the underside of the jaw 7 by screws 36. The upper edge of the slide 19 is formed with a rack 37 that can interfit with a toothed element 38 bolted underneath the jaw 7. When the screws 36 are loosened enough to permit the teeth of the rack 37 and element 38 to disconnect, the jaw 7 can be slid along the slide 19 to a new position.

Thus any offcenter forces applied to either of the jaws 2 or 7 will not be transmitted to the spindle 8 at all. The jaw 7 is relatively long and any canting of it in the slot 31 will be minor and, in any case, will be isolated from the spindle 8 by pivoting of the nut 10 in the slide 19. At the other end any canting of the jaw 2 about the axis 21 will be isolated from the spindle 8 by pivoting of the support 16 and its pin 23 in the jaw 2. This makes it possible to reconstruct the vise according to this invention to relatively low tolerances while still not having any binding on the spindle 8, even when the workpiece is being clamped between the jaws 2 and 7 when it is well off center.

I claim:

1. A vise comprising:

a housing block formed with a guide extending along and defining a longitudinal direction;

a fixed jaw secured and not movable relative to the block;

a movable jaw displaceable in the direction in the guide relative to the fixed jaw;

a spindle extending through the housing block jaws along a spindle axis generally parallel to the direction;

a support mounted on the spindle at the fixed jaw;

means including interengaging formations between the support and the fixed jaw for fixing the support and fixed jaw together against relative axial displacement while permitting limited pivoting of the support relative to the fixed jaw about a fixed-jaw axis generally perpendicular to the spindle axis and direction;

a bearing between the spindle and the support fixing the support against relative displacement along the spindle axis while permitting the spindle to rotate relative to the support about the spindle axis;

a nut threaded on the spindle at the movable jaw; and means including interengaging formations between the nut and the movable jaw for fixing the nut and movable jaw together against relative displacement parallel to the spindle axis while permitting limited pivoting of the nut on the movable jaw about a movable-jaw axis generally parallel to the fixed-jaw axis whereby the spindle has limited pivotability with respect to the fixed and movable jaws.

2. The vise defined in claim 1 wherein the formations between the support and fixed jaw include a pin centered on the fixed-jaw axis and projecting from the support and a complementary recess formed in the fixed jaw.

3. The vise defined in claim 2 wherein the guide includes a pair of substantially parallel surfaces extending parallel to the spindle axis and perpendicular to the jaw axes and both the support and movable jaw are supported on these surfaces.

4. The vise difined in claim 3 wherein the guide is a pair of groves open toward each other and having flanks forming the surfaces.

5. The vise defined in claim 1 wherein the formations between the movable jaw and the nut include an outer surface on the nut formed as a body of revolution centered on the movable-jaw axis and a complementary recess formed in the movable jaw.

6. The vise defined in claim 5 wherein the body of revolution is a cylinder and the nut has a diametral threaded bore receiving the spindle.

7. The vise defined in claim 5 wherein the movable jaw is formed centered on the spindle axis with a throughgoing bore receiving the spindle with substantial play.

8. The vise defined in claim 5 wherein the movable jaw is provided with a slide movable in the quide and receiving the nut with with means for displacing the movable jaw along the spindle axis relative to the slide.

9. A vise comprising:

a housing block formed with a guide groove defining a longitudinal direction;

a fixed jaw secured and not movable relative to the block;

a movable jaw spaced in the direction on the block from the fixed jaw;

a spindle extending in the direction between the jaws along a spindle axis generally parallel to the longitudinal direction;

a support mounted on the spindle in the groove at the fixed jaw and provided with a pivot pin projecting along a fixed-jaw axis perpendicular to the spindle axis, the fixed jaw being formed with a recess complementary to and receiving the pin, whereby the support can pivot about the fixed-jaw axis relatiive to the fixed jaw on the pin;

a bearing between the spindle and the support fixing the support against relative displacement along the spindle axis while permitting the spindle to rotate relative to the support about the spindle axis;

a nut threaded on the spindle at the movable jaw and having a surface centered on a movable-jaw axis perpendicular to the spindle axis and parallel to the fixed-jaw axis; and a slide carrying the movable jaw, displaceable along the guide, and formed with a recess complementary to and receiving the surface of the nut, whereby the nut can pivot relative to the movable jaw and slide about the movable-jaw axis whereby the spindle has limited pivotability with respect to the fixed and movable jaws.

* * * * *